United States Patent [19]

Örnberg

[11] 4,370,001

[45] Jan. 25, 1983

[54] BASIC FRAME FOR AN ADJUSTABLE DAMPER-ACTUATED CHAIR

[76] Inventor: Stellan Örnberg, Klintvägen 3, 552 59 Jönköping, Sweden

[21] Appl. No.: 189,408

[22] Filed: Sep. 22, 1980

[30] Foreign Application Priority Data

Jul. 1, 1980 [SE] Sweden ..... 8004875

[51] Int. Cl.[3] ..... A47C 1/02

[52] U.S. Cl. ..... 297/355; 248/188.7; 297/361; 297/458; 297/460

[58] Field of Search ..... 297/355, 354, 361, 458, 297/460, 443, 445, 377, 349, 90, 91; 248/188.7

[56] References Cited

U.S. PATENT DOCUMENTS

| | | | |
|---|---|---|---|
| 2,711,211 | 6/1955 | Tidcombe | 297/349 X |
| 2,966,208 | 12/1960 | Good | 297/411 |
| 3,815,956 | 6/1974 | Bocksch et al. | 297/411 X |
| 3,827,750 | 8/1974 | Fantoni | 297/445 |
| 3,907,363 | 9/1975 | Baker | 297/445 |
| 4,200,332 | 4/1980 | Bräuning | 297/355 X |
| 4,218,091 | 8/1980 | Webster | 297/354 |

FOREIGN PATENT DOCUMENTS

| | | | |
|---|---|---|---|
| 2545991 | 4/1976 | Fed. Rep. of Germany | 297/355 |
| 1077801 | 5/1954 | France | 297/354 |

*Primary Examiner*—James T. McCall

*Attorney, Agent, or Firm*—Blanchard, Flynn, Thiel, Boutell & Tanis

[57] ABSTRACT

The invention provides a generally usable, extremely simplified basic framework for a chair such as an easy chair with an adjustable back support, which can be locked in different positions. The basic framework including the necessary mechanism for adjusting the back and locking it in a desired position. Said framework comprises two simple frames or panels, forming a seat part and a more elongate back support part, and a frame holder united to the seat part for carrying the framework. Both parts are joined to each other by means of a transverse hinge in such a way that a lever of a given length is formed between the hinge and the adjacent short side of the back support part. A gas damper is articulately coupled between the said short side of the back part and the holder joined to the seat part. The back support part is caused to swing by the stroking movement of the gas damper and, by closing off the gas transfer duct in the damper by means of an operating lever, the framework can be locked with the back portion assuming the desired sloping attitude.

6 Claims, 8 Drawing Figures

BASIC FRAME FOR AN ADJUSTABLE DAMPER-ACTUATED CHAIR

The present invention relates to chairs such as easy chairs and the like having adjustably inclinable backs, the adjusting movement being controlled and operated with the aid of a gas damper.

Chairs, particularly easy chairs and the like with adjustable backs, are to be found in great variety, and common to them all is that they have a certain structural complication making furniture of this kind rather costly. In one arrangement the chair seat is made forwardly and backwardly displaceable and coupled to the back in such a way that when the seat glides forward the back is inclined backwards and vice versa. In another embodiment the back is downwardly hinged and arranged lockable in different angular attitudes with the help of a hand-operated clamp means. More or less complicated spring structures are used to balance out the weight of the components and to facilitate operation.

The invention has the object of providing a basic framework structure to a chair or easy chair of the kind under consideration, said framework including, per se, the entire operating mechanism required for the movement involved in adjusting the reclining attitude of the chair, and enabling chairs in a variety of different types to be constructed e.g. with or without arm rests, with different kinds of base structure and with different types of cushions or upholstery for the seat and back. Also, the invention intends to bring down, by means of the new basic framwork structure, the costs for this type of furniture to a great degree.

The invention will now be described by way of example while referring to the accompanying diagrammatic drawings, on which FIGS. 1–3 are respectively front, side and plan views of a seat part incorporated in the basic framework in accordance with the invention, FIG. 1 more specifically being a section along the line I—I in FIG. 3.

Figure 1:
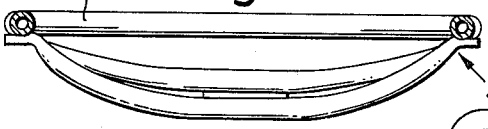

As will be seen from the drawings, the inventive basic framework 10 of the chair comprises two simple, commonly hinged frame parts, namely a seat part 20 and a back support part 40. The hinge joint 12 between the frame parts is arranged such that the back part is given a short lever arm x in relation to the seat part, which is utilised for connecting one end of a gas damper 15, the other end of which is connected to a suitable point on the seat part in such a way that the gas damper regulates the articulated movement between the parts, as will be described.

Figure 2:
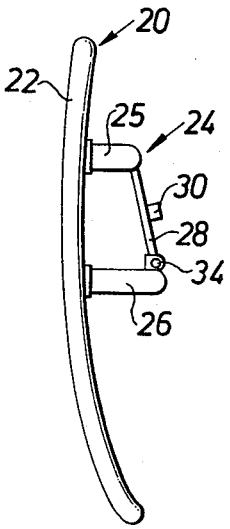
Figure 3:
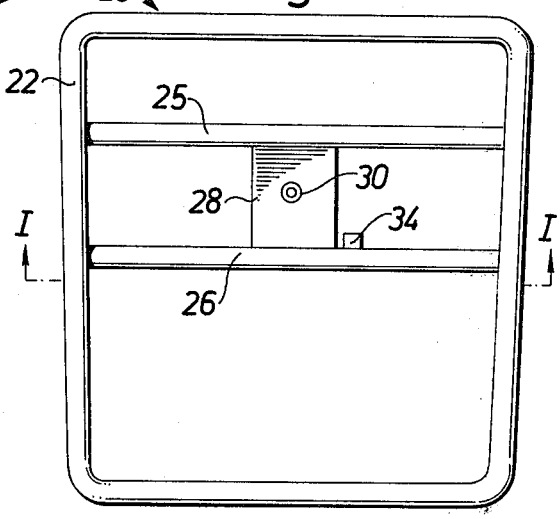

The seat part 20 illustrated in FIGS. 1–3 comprises a generally quadratic frame 22, preferably made from steel tubing. A frame holder 24 comprises two parallel pipe arches 25 and 26 extending across the frame 22 and welded or screwed onto opposite sides of the frame. The pipe arches are united by means oa a centrally arranged bridge plate 28, in turn carrying a centrally mounted journalling pin, journalling sleeve or the like 30 for connect on to a base structure.

Figure 4:
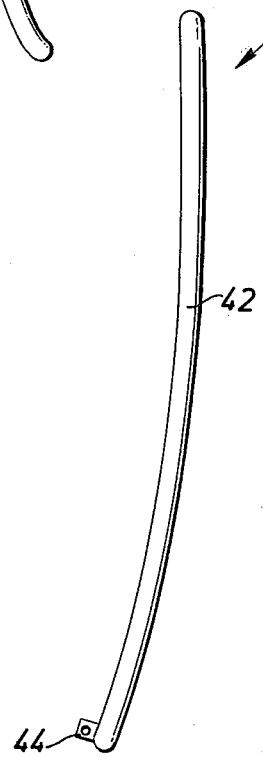
FIGS. 4 and 5 are side and front views of a back support part incorporated in the basic framework.
Figure 5:
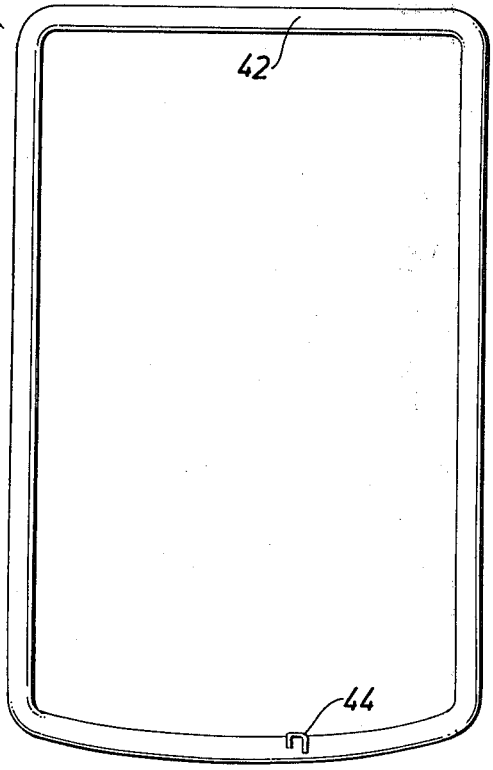

The back support part 40 illustrated in FIGS. 4 and 5 likewise comprises a frame 42, preferably formed from steel tubing, with substantially the same width as the frame 22 but extended so that as a whole the frame has a rectangular shape.

Seen from one side, both frames 22 and 24 are somewhat curved, which will be seen from FIGS. 2 and 4, to match up with the desired chair profile, see below.

Figure 6:
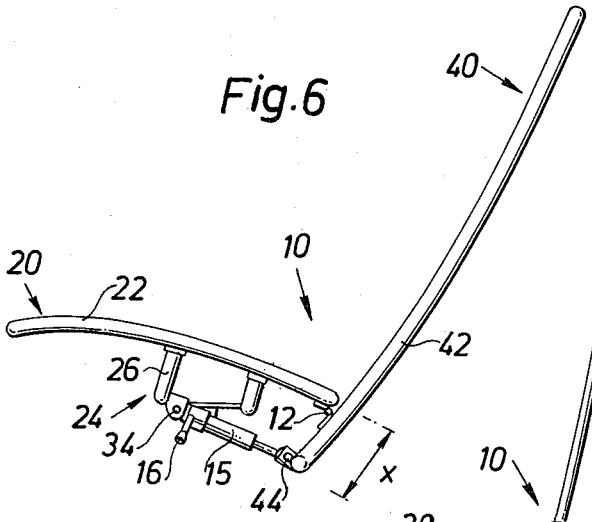
FIG. 6 is a side view of the complete basic framework in accordance with the invention.

It will be seen in FIG. 6 how both frame parts 20 and 40 commonly form the inventive basic framework 10 of the chair. Along one side of the frame 22 there extends a hinge 12, e.g. of the piano hinge type, and at its ends the hinge is joined to the backframe 42 at two opposing points, one on either side of the frame and at the same distance from one short side of the frame, as will be seen from FIG. 6. A small portion of the back part will thus depend a distance x below the seat frame part 20. On this downwardly projecting portion, or more specifically on the short side of the frame 42, an attachment lug 44 is welded, see FIGS. 4 and 5, and at a point opposite this lug a fastening lug 34 is welded on the pipe arch 26 of the frame holder 24, see FIGS. 2 and 3. Between both lugs 34 and 44 there is pivotably arranged a gas damper 15, the dimensions being adapted such that in an extended condition the damper maintains both parts 20 and 40 of the framework at a suitable inclination to each other, see FIG. 6, said inclination corresponding to the angle between the seat and back of a chair of the kind in question in its upright attitude. As will be seen, the damper 15 is somewhat excentrically placed in relation to the centre lines of the frame parts.

The damper 15 is of a type known per se, and comprises a cylinder accommodating a reciprocating piston connected to a piston rod projecting out from a seal at one end of the cylinder. The other end of the cylinder is provided with a pivoting means, there also being such a means adapted on the free end of the piston rod, and these two means are joined to the above-mentioned attachment lugs 34 and 44, respectively, for providing the necessary articulation. The cylinder is filled with gas under high pressure, and the cylinder chambers formed on either side of the piston are in mutual communication via a bypass duct which can be closed by a valve. When the latter is open the damper will extend, i.e. the piston rod will be thrust out, since the effective area of the piston on the piston rod side is less than that on the other side, so that a net force results, which urges the piston to its end position of maximum extension of the piston rod. To press the piston rod in again it is necessary to overcome the net pressure difference between both sides of the piston, which gives the spring action of the device. The gas system is completely enclosed by means of extremely effective seals, and the piston can be locked anywhere between its end positions by quite simply closing the above-mentioned valve, so that gas can not pass between the cylinder spaces on either side of the piston. The valve is very easily operated and is acted on exteriorly by means of a lever 16, see FIGS. 6–8. A special advantage with the gas damper is its very flat spring characteristic, as well as its large development of force, which means that the spring not only develops a large spring force, but also that this force varies very moderately over the operating range of the damper.

Figure 7:
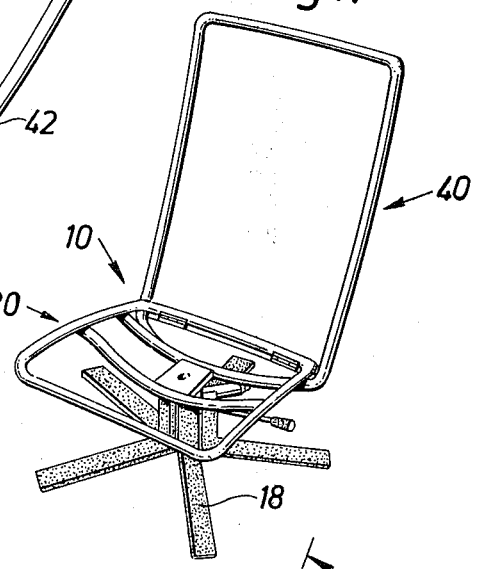
FIG. 7 is a perspective view of the same framework mounted on a base structure of known type. Finally.

The inventive basic framework 10 of the chair is illustrated in FIG. 7 mounted on a base structure or foot 18, e.g. according to the Swedish Design Registration No. 22 836 published in the Swedish TM Gazette dated Sept. 22, 1976 and registered on Oct. 4, 1978. The framework is mounted on the foot swivelable in a horizontal plane with the aid of a journalling pin indicated by 30 in FIGS. 2 and 3.

Figure 8:
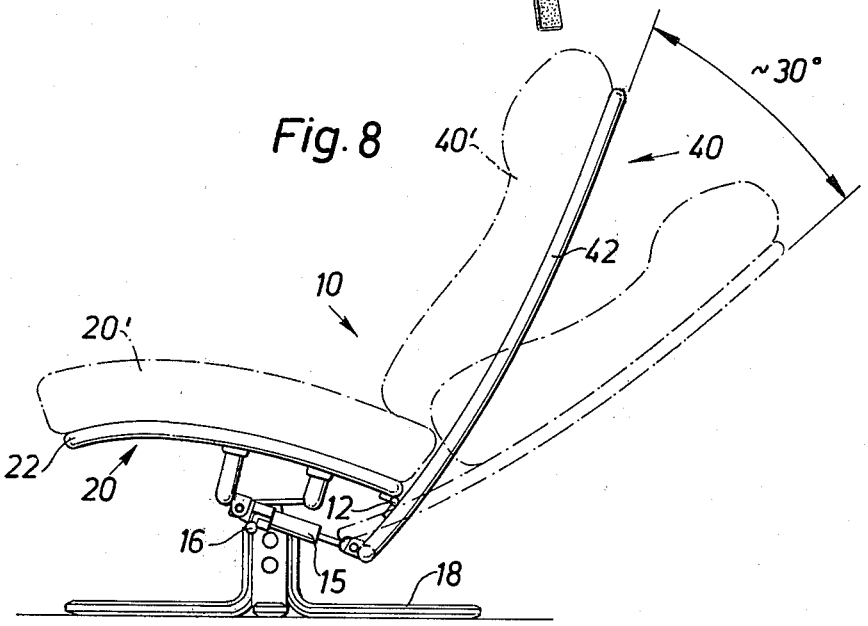
FIG. 8 is a side view of the framework mounted on the base structure and with covering or upholstery indicated, the figure illustrating how the completed chair assumes different positions of adjustment.

As has been mentioned above, the framework 10 thus executed and provided with a gas damper can be supplemented with seat and back cushions of varying appearance, which are combined with the seat part and back part of the framework, as is indicated at 20' and 40' in FIG. 8. If so desired, the framework can easily be provided with arm rests, which can be attached to the sides of the seat frame 22, utilizing the same attachment points as those between the frame holder 24 and seat frame 22. The arm rests, e.g. in the form of a light tubular structure or a curved plate, can subsequently extend upwards on both sides of the seat part 20 and be conventionally provided with support rails or upholstery for the forearms of the person sitting in the chair.

FIG. 8 also illustrates how the adjustment movement of the back is carried out. The sitting person opens the valve of the damper 15 by a light movement on the lever 16 and can then, while overcoming a light pressure, adjust the chair to the desired position, in which its back can then be locked by releasing the lever 16. A small portion (with the length x, see FIG. 6) of the back frame 42 is thus utilized as a lever, so that the damper 15 can exercise a turning moment on the back as a whole, acting about the hinge 12 between the two parts of the basic framework. For an easy chair or the like made with a framework in accordance with the invention it is striking how the back has such smooth and moderate resistance to backwards adjusting movement, compared with conventional chairs provided with conventional spring units. The total range of the swinging adjustment movement is also rather large, about 30°.

As has been pointed out above, the hinged basic framework in accordance with the invention can form a supporting structure in adjustable chairs and furniture of the most varying appearance. In most cases, the described simple tubular structure will be sufficiently stiff and steady for its purpose, especially if the cushions used in its upholstery are made stiff and more or ledd self-supporting. However, without departing from the inventive concept, both simple seat and back frames, and especially the latter, can naturally be provided with extra stiffeners if such should be required. One skilled in the art ought also be able to suggest modifications and constructive variations in other respects also, within the scope of the invention.

I claim:

1. A chair structure having an adjustable back which can be locked in different positions, comprising:

a framework comprising frames of substantially rigid tubing, namely a seat frame and a back support frame;

a frame holder fixed to and underlying the seat frame for supporting the framework as a whole on a base structure, such that the framework is swivelable on the base structure about a vertical axis in the middle plane of the framework; and the improvement comprised in that said seat frame and back frame are each a simple, closed, essentially rectangular loop of said tubing, said loops being of essentially the same width, the seat loop being shorter and almost square, the back loop being substantially longer, hinge means uniting the seat loop along its back segment with the back loop, said hinge means extending transversely across the back loop at a distance (x) from the bottom segment thereof, so that the bottom portion of the back loop which is between its said bottom segment and said hinge means forms a lever for limiting motion of said back loop in relation to the seat loop, the frame holder fixed to the seat loop comprising a downwardly convex transverse arch structure fixed at its opposite ends to the two side segments of the seat loop, said bottom portion of the back loop extending in underneath the seat loop such that the bottom segment of the back loop is spaced forward of as well as below the rear segment of said seat loop and opposes said downwardly convex arch structure, and a gas damper lockable in optional positions, said gas damper being spaced entirely below the rear portion of the seat loop and extending approximately parallel to the plane thereof in connected relation from said bottom segment of the back loop to the downward arched portion of the frame holder.

2. A chair structure as claimed in claim 1, wherein the arch structure forming the frame holder comprises two generally parallel and downwardly convex tubular arches, which are united at their middle portions by a substantially horizontal bridge plate and at their ends are fixed to the seat loop side segments.

3. A chair structure as claimed in claim 2, wherein said bridge plate is provided with a bearing bush or the like for swivelably mounting the framework on the base structure.

4. A chair structure as claimed in claim 2, wherein the gas damper is coupled in between two lugs, one mounted on the bottom segment of the back loop and the other on the front arch of the tubular arches of the frame holder to one side of said bridge plate.

5. A chair structure as claimed in claim 1, wherein the attachment points between the seat loop and the frame holder are adapted to carry structures for arm rests, the hinge means being of piano hinge type extending the width of said loops with one hinge leaf fixed to said side segments of said back loop and the other hinge leaf fixed along the length of said back segment of said seat loop to locate same just ahead of said back loop.

6. A chair structure having an adjustable back which can be locked in different positions, comprising:

a framework comprising frames of substantially rigid tubing, namely a seat frame and a back support frame;

a frame holder fixed to and underlying a seat frame for supporting the framework as a whole on a base structure, such that the framework is swivelable on the base structure about a vertical axis in the middle plane of the framework; and the improvement comprised in that said seat frame and back frame are each a simple, closed, essentially rectangular loop of said tubing, said loops being of essentially the same width, the seat loop being shorter and almost square, the back loop being substantially longer, hinge means uniting the seat loop along its back segment with the back loop, said hinge means extending transversely across the back loop at a distance (x) from the bottom segment thereof, so that the bottom portion of the back loop which is between its said bottom segment and said hinge means forms a lever for limiting motion of said back loop in relation to the seat loop, the frame holder fixed to the seat loop comprising a downwardly convex transverse arch structure fixed at its opposite ends to the two side segments of the seat loop, said bottom portion of the back loop extending in underneath the seat loop such that the bottom segment of the back loop is spaced forward of as well as below the rear segment of said seat loop and opposes said downwardly convex arch structure, and a gas damper lockable in optional positions, said gas damper being spaced entirely below the rear portion of the seat loop and extending approximately parallel to the plane thereof in connected relation from said bottom segment of the back loop to the downward arched portion of the frame holder, the arch structure forming the frame holder comprising front and rear generally parallel and downwardly convex tubular arches which are united at their depending middle portions by a substantially horizontal bridge plate swivelably mounted on the base structure, the ends of said arches being fixed to the seat loop side segments, the front arch being deeper than the rear arch, the depth of the front arch being approximately said distance (x), said gas damper extending between said front arch and said back loop bottom segment in spaced relation beneath said rear arch, the length of the seat loop being smoothly curved convexly upward away from said arches, as seen from the side, by continuous curvature of its side segments while the length of the back loop is smoothly curved concavely forward as seen from the side by continuous curvature of its side segments.

* * * * *